US007434658B2

(12) United States Patent
Staut

(10) Patent No.: US 7,434,658 B2
(45) Date of Patent: Oct. 14, 2008

(54) MUFFLER

(75) Inventor: Michael Staut, Schiffweiler (DE)

(73) Assignee: J. Eberspaecher GmbH & Co. (DE)

( * ) Notice: Subject to any disclaimer, the term of this patent is extended or adjusted under 35 U.S.C. 154(b) by 244 days.

(21) Appl. No.: 11/269,004

(22) Filed: Nov. 8, 2005

(65) Prior Publication Data

US 2006/0096805 A1 May 11, 2006

(30) Foreign Application Priority Data

Nov. 10, 2004 (DE) ..... 10 2004 054 441

(51) Int. Cl.
*F01N 1/16* (2006.01)

(52) U.S. Cl. ..... 181/271

(58) Field of Classification Search ..... 181/276, 181/271, 243, 277; 248/56, 68.1, 71
See application file for complete search history.

(56) References Cited

U.S. PATENT DOCUMENTS

| | | | | | |
|---|---|---|---|---|---|
| 1,335,872 | A * | 4/1920 | Brown | 181/271 |
| 1,340,158 | A * | 5/1920 | Delavan | 181/277 |
| 1,995,542 | A * | 3/1935 | Haviland | 285/322 |
| 2,131,001 | A * | 9/1938 | Prochnow | 181/276 |
| 2,244,393 | A * | 6/1941 | Haas | 181/243 |
| 3,106,984 | A * | 10/1963 | Carter | 181/238 |
| 3,315,761 | A * | 4/1967 | Selig | 181/266 |
| 3,557,905 | A * | 1/1971 | Rutt | 181/276 |
| 4,023,645 | A * | 5/1977 | Retka et al. | 181/276 |
| 4,291,905 | A * | 9/1981 | Schrock | 285/192 |
| 4,846,302 | A * | 7/1989 | Hetherington | 181/243 |
| 5,227,593 | A * | 7/1993 | Takahashi et al. | 181/255 |
| 5,309,844 | A * | 5/1994 | Zollinger | 104/138.2 |
| 5,331,810 | A * | 7/1994 | Ingermann et al. | 60/322 |
| 5,340,165 | A * | 8/1994 | Sheppard | 285/226 |
| 5,477,015 | A * | 12/1995 | Preslicka et al. | 181/282 |
| 5,581,056 | A * | 12/1996 | Bellgardt et al. | 181/282 |
| 5,898,140 | A * | 4/1999 | Asao et al. | 181/272 |
| 6,189,650 | B1 * | 2/2001 | Inuzuka et al. | 181/254 |
| 6,467,570 | B1 * | 10/2002 | Herold | 181/231 |
| 6,554,100 | B2 * | 4/2003 | Kim | 181/279 |

(Continued)

FOREIGN PATENT DOCUMENTS

| | | |
|---|---|---|
| DE | 800924 | 12/1950 |
| DE | 29904934 | 8/2000 |
| DE | 10157131 | 11/2003 |
| EP | 0759502 | 2/1997 |

*Primary Examiner*—Lincoln Donovan
*Assistant Examiner*—Forrest Phillips
(74) *Attorney, Agent, or Firm*—Howard IP Law Group, PC

(57) ABSTRACT

The present invention relates to a muffler for a line conveying gas and airborne sound, in particular for an exhaust system of an internal combustion engine, preferably in a motor vehicle. The muffler has a housing in which there are at least two inside pipes for carrying gas in the interior of the housing and which contains at least one inside plate for reinforcing the housing. The two inside pipes are inserted one inside the other in a sliding seat area and are axially movable in relation to one another.

9 Claims, 3 Drawing Sheets

U.S. PATENT DOCUMENTS 6,910,506 B2 * 6/2005 Gabriel et al. ..... 138/114
2003/0094208 A1 * 5/2003 Gabriel et al. ..... 138/120
2005/0252716 A1 * 11/2005 Moenssen et al. ..... 181/277
2006/0096805 A1 * 5/2006 Staut ..... 181/271
2006/0124384 A1 * 6/2006 Tary et al. ..... 181/243
2006/0251470 A1 * 11/2006 Prause ..... 403/119

* cited by examiner

MUFFLER

FIELD OF THE INVENTION

The present invention relates to a muffler for a line carrying gas and airborne sound, in particular for the exhaust system of an internal combustion engine, preferably in a motor vehicle.

BACKGROUND OF THE INVENTION

To reduce noise emission into the environment by a gas-carrying line in which the gas flow also carries airborne sound, it is conventional to use a muffler of the type defined above in such a line. The gas transported in the line flows through the muffler. At the same time, the airborne sound entrained with the gas enters the muffler and is dampened there, e.g., by reflection, resonance and sound absorbent materials. The gas then flows out of the muffler at a reduced airborne sound level. Such mufflers are preferably used in the exhaust systems of internal combustion engines, in particular in motor vehicles, to dampen the sound generated by the internal combustion engine, propagating through the exhaust system. Likewise it is fundamentally possible to provide a muffler in the fresh air system of an internal combustion engine to dampen the sound generated by a compressor for an exhaust gas turbocharger, for example. However, the suppression of airborne sound may also be of interest with other lines that carry gas, so the present invention should not essentially be limited to applications in internal combustion engines.

Thermal expansion effects will necessarily occur if the line in which the sound propagation that is to be suppressed is carrying hot gases, as is the case with the exhaust system of an internal combustion engine, for example. To prevent the resulting damage to the muffler, it is customary in the case of inside pipes that carry gases and run in the interior of a housing of the muffler to insert one pipe inside the other so that they have axial mobility in relation to one another and thereby create a sliding seat. Thermally induced expansion effects can be compensated thereby in such a sliding seat because the two inside pipes are axially movable in relation to one another in this sliding seat. In addition, it is conventional to reinforce the housing of such a muffler by providing at least one inside plate. Depending on the gas guidance in the interior of the muffler, the inside pipes must be passed through such an inside plate. At the same time, such inside plates are utilized to secure the inside pipes in the housing. It is conventional here to mount one inside pipe on a first inside floor in proximity to the sliding seat and to mount the other inside pipe on a second inside floor, which is spaced a distance away from the first inside plate. The two inside plates are arranged on both sides of the sliding seat. To stabilize the inside pipes as effectively as possible in the housing, it is expedient to support the two inside pipes over the two inside plates as close to the sliding seat as possible. Since the two inside plates are therefore only a comparatively small distance away from one another, the housing has a particularly high rigidity in this area. However, the introduction of such an inside plate is associated with a comparatively high cost, at least in mass production. Furthermore, this increases the weight of the muffler.

SUMMARY OF THE INVENTION

The present invention relates to the problem of providing an improved embodiment for a muffler of the type defined in the preamble such that it is characterized in particular by a reduced weight and an inexpensive design.

This invention is based on the general idea of mounting both inside pipes on one and the same inside plate and to this end, providing at least one elastic first tongue attached to an inside pipe and at least one elastic second tongue attached to the other inside pipe, the second tongue having elastic mobility independently of the at least one first tongue. Due to this design, the elastic tongues can follow the thermally induced changes in lengths of the inside pipes independently of one another without resulting in unacceptably high stresses inside the inside plate. It is of particular advantage in the present invention that a complete inside plate can be eliminated, which entails great cost savings and weight reduction. The invention here is utilizing the finding that a sufficient reinforcement in the area of the housing that is to be reinforced can be achieved with just a single inside plate in this area so that a second inside plate is not necessary, at least with regard to the reinforcement of the housing in this section of the housing. It is also important for the present invention that the two inside pipes are supported on the housing independently of one another in the area of the sliding seat via the one common inside plate, thereby resulting in stable positioning in a fixed position for both inside pipes in the housing.

According to an advantageous embodiment, the tongues may be designed by free cutting or free punching on the inside plate. In this way the tongues can be manufactured especially easily and inexpensively. The tongues are integrated into the inside plate and/or form an integral component with the inside plate. This integral design has the advantage that no separately manufactured tongues need be mounted on the inside plate with additional labor.

In another advantageous embodiment, the inside pipes may be arranged at a distance radially from one another in the area of the sliding seat. This means that in the sliding seat, the inside pipes have a radial clearance and do not come in contact with one another. Such a sliding seat is necessarily leaky, although this is harmless, depending on the flow guidance in the muffler. In this non-contact sliding seat, it is advantageous that bracing of the two inside pipes together in the sliding seat can be avoided in particular due to thermally induced radial expansion, thereby ensuring the axial mobility of the two inside pipes in the sliding seat accordingly.

Other important features and advantages of this invention are derived from the claims, the drawings and the respective description of figures on the basis of the drawings.

It is self-evident that the features mentioned above and those yet to be explained below can be used not only in the particular combination given but also in other combinations or even alone without going beyond the scope of the present invention.

A preferred exemplary embodiment of the present invention is depicted in the drawings and explained in greater detail in the following description, where the same reference notation is used to refer to the same or functionally same or similar components.

BRIEF DESCRIPTION OF THE FIGURES

The drawings are schematic diagrams, which show.

DETAILED DESCRIPTION OF THE INVENTION

Figure 1:
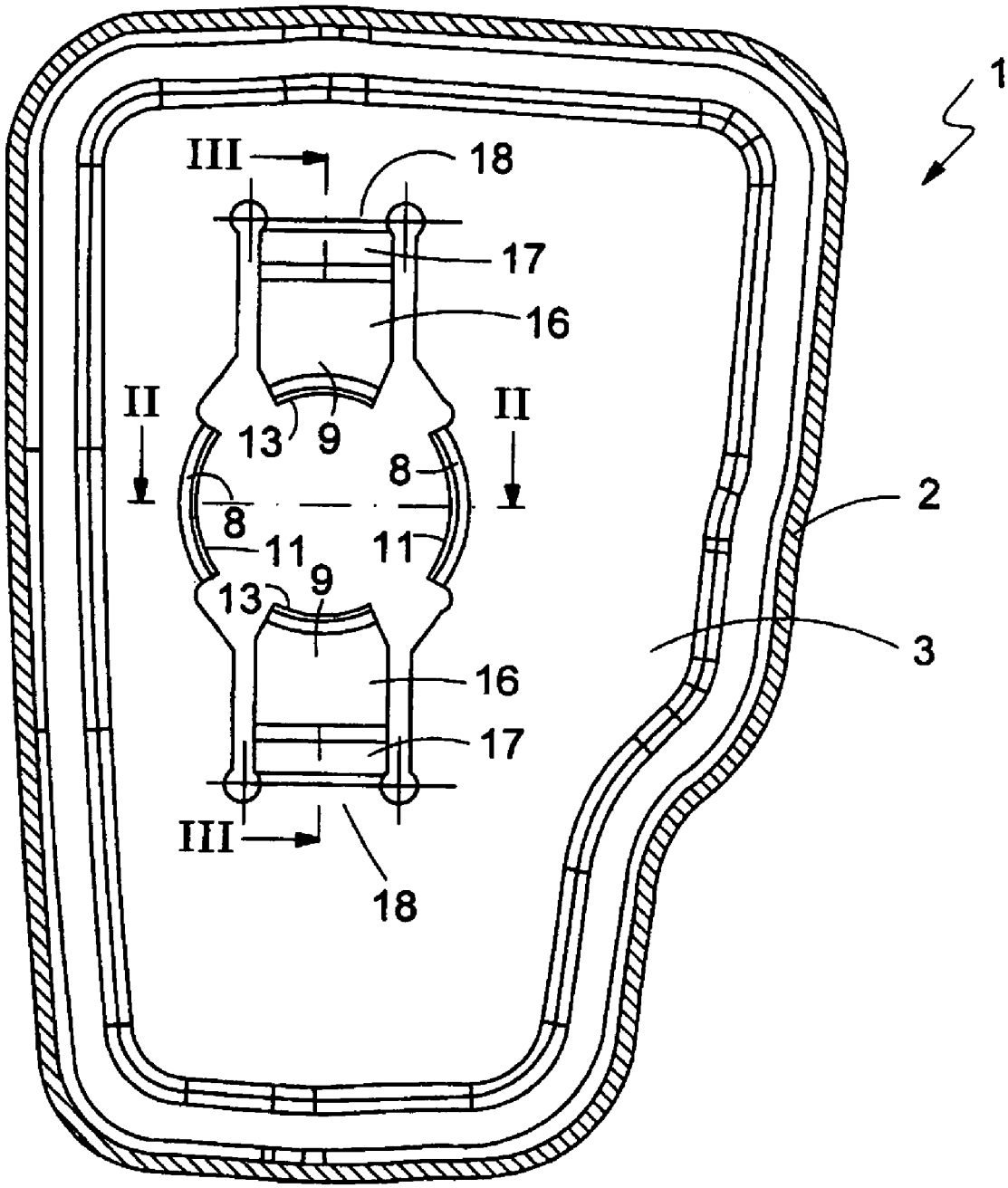
FIG. 1 is a cross section through a muffler according to this invention in the area of an inside plate, although the inside pipes have been omitted to simplify the diagram.
Figure 2:
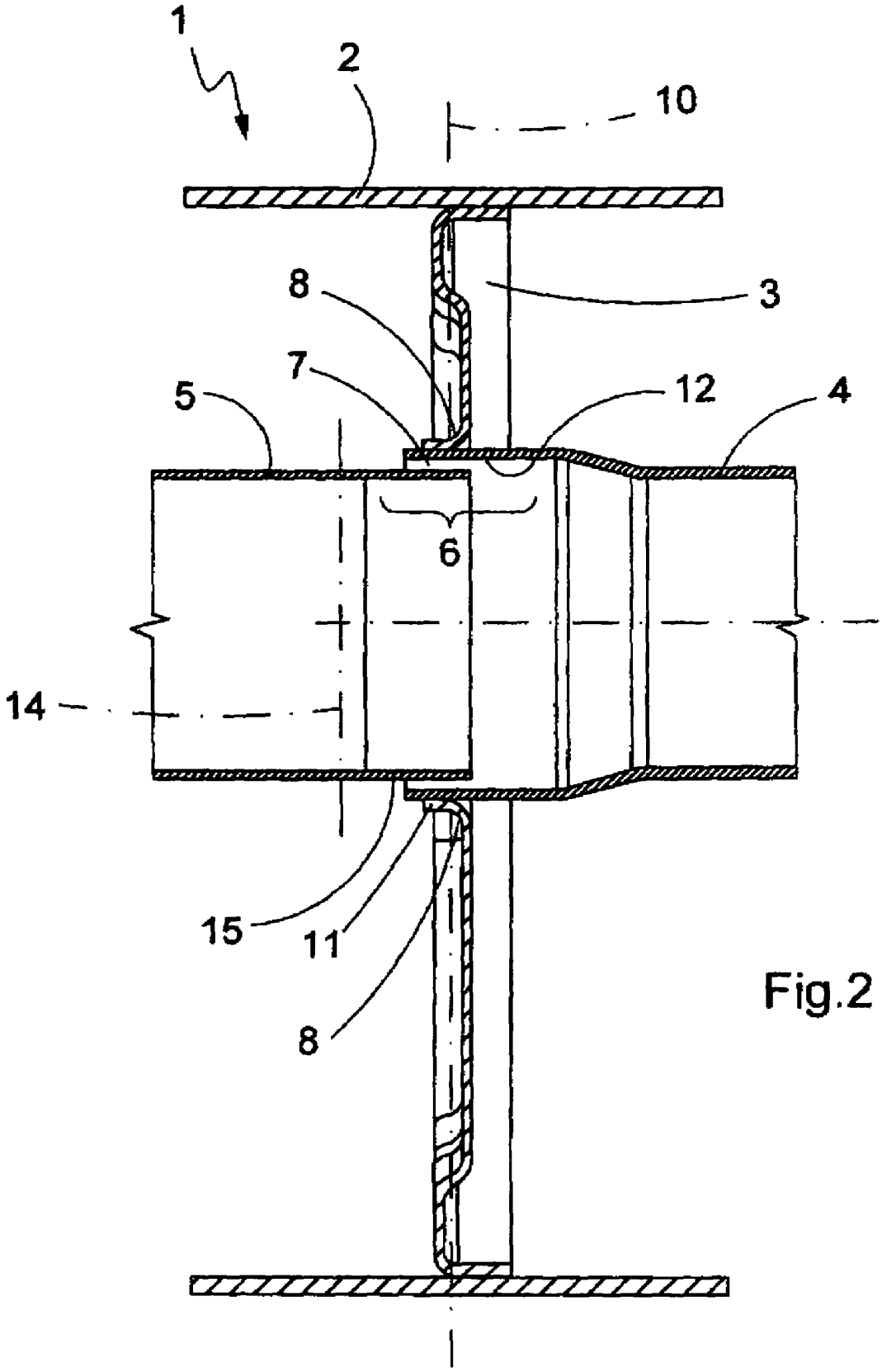
FIG. 2 is a longitudinal section according to sectional lines II in FIG. 1 in a sliding seat area of the inside pipes.
Figure 3:
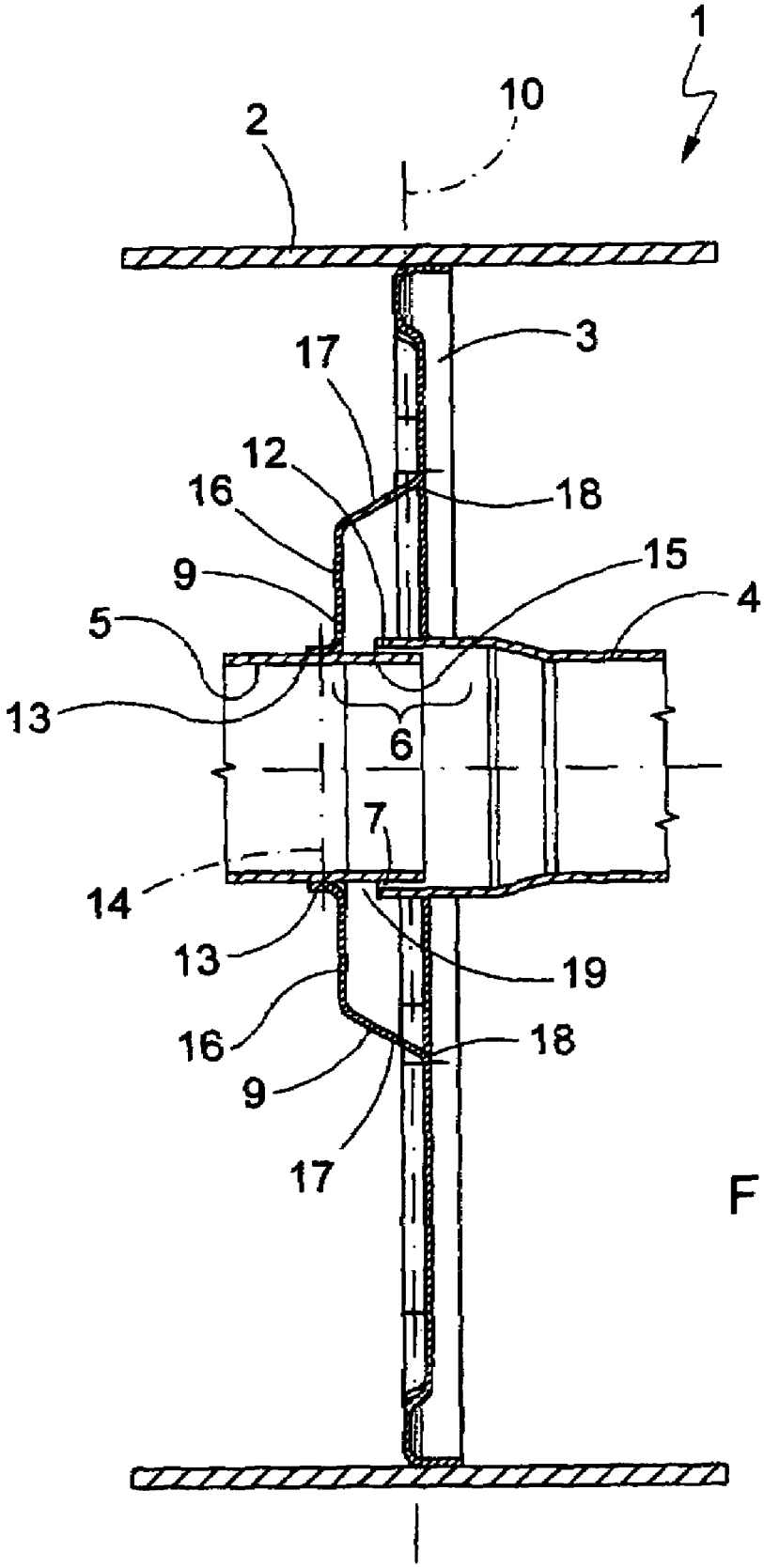
FIG. 3 is a longitudinal section through the sliding seat area according to the sectional lines III in FIG. 1.

According to FIGS. 1 through 3, an inventive muffler 1 comprises a housing 2 in which there are at least one inside plate 3 and at least two inside pipes, namely a first inside pipe 4 and a second inside pipe 5. The muffler here is designed as a muffler 1 for an exhaust system of an internal combustion engine, preferably in a motor vehicle, without restricting the general scope of this invention. Essentially however the muffler 1 may be provided for any other line carrying gas and airborne sound.

The inside plate 3 serves to reinforce the housing 2. It is clear that the housing 2 may essentially also be equipped with more than one inside plate 3. The inside pipes 4, 5 are used for carrying gas in the interior of the housing 2, in particular for carrying exhaust gas. In other words, the muffler 1 has flowing through it the gas conveying the airborne sound flows at least through its inside pipes 4, 5 of the muffler 1. It is also clear here that the muffler 1 may essentially also have more than two inside pipes. The muffler 1 may be designed in the usual way as an absorption muffler and may contain absorbent materials accordingly. In addition, the muffler 1 may work with resonance effects and/or with reflection to dampen the airborne sound entrained in the gas.

According to FIGS. 2 and 3, the two inside pipes 4, 5 are inserted axially one into the other in a sliding seat area 6 indicated by curly brackets, such that they are axially movable in relation to one another. In the specific embodiment illustrated here, the two inside pipes have a radial play 7 in the sliding seat area 6, i.e., the two inside pipes 4, 5 are spaced a distance apart from one another radially in the sliding seat area 6.

The two inside pipes 4, 5 pass through the inside plate 3 in the sliding seat area 6. In addition, the two inside pipes 4, 5 are each mounted separately on this one common inside plate 3. To this end, the inside plate 3 has at least one first tongue 8 according to FIGS. 1 and 2. In the present exemplary embodiment, two first tongues 8 are provided, arranged so they are diametrically opposed to one another. The first tongues 8 are designed with elasticity and each is fixedly connected to the first inside pipe 4 in the sliding seat area 6. For example, the first tongues 8 are soldered or welded to the outside of the first inside pipe 4.

According to FIGS. 1 and 3, the inside plate 3 also has at least one second tongue 9. In the present preferred exemplary embodiment, two second tongues 9 are provided and are situated so they are diametrically opposed to one another. The first tongues 8 and the second tongues 9 are expediently aligned perpendicular to one another, i.e., arranged with a 90° offset to one another. The second tongues 9 are fixedly connected to the second inside pipe 5 and are also designed with elasticity. It is essential that the second tongues 9 have elastic mobility essentially independently of the first tongues 8. This may be accomplished through a suitable design, in particular with regard to the positioning, shaping and dimensioning.

In the case of thermally induced expansion effects, the first inside pipe 4 can expand axially. This axial movement of the first inside pipe 4 is not critical with regard to the second inside pipe 5 because the sliding seat area 6 allows an axial adjustment of the two inside pipes 4, 5 in relation to one another. With regard to the inside plate 3, the axial adjustment of the first inside pipe 4 is also noncritical because due to of their elasticity, the first tongues 8 can elastically follow the axial movement of the first inside pipe 4. The elasticity of the relatively short first tongues 8 is implemented here through the elasticity of the inside plate 3 on which the first tongues 8 are situated, i.e., provided. The inside plate 3 is therefore designed with a reversible bulge.

The situation is also similar for thermal expansion of the second inside pipe 5. The length of the second inside pipe 5 can also change due to thermal conditions. Due to the axial mobility with respect to this first inside pipe 4 in the sliding seat area 6, there can be no bracing with the first inside pipe 4. With regard to the inside plate 3, the changes in length of the second inside pipe 5 are also noncritical because the second tongues 9 can elastically follow these axial movements of the second inside pipe 5 due to their elasticity. The elasticity of the second tongues 9 is implemented here by a comparatively great length of the second tongues 9. To this extent, there is little or no bending of the inside plate 3 when elastic bending of the second tongues 9 occurs. Interfering interactions in elastic yielding of the tongues 8, 9 can be avoided in this way. To this extent, the tongues 8 and 9 are movable by elasticity independently of one another.

At least the first tongues 8 or at least the second tongues 9, but preferably all tongues 8, 9 are expediently molded integrally on the inside plate 3. This is achieved, for example, by free cutting or free punching the tongues 8, 9 on the inside plate 3. Alternatively, it would be possible fundamentally to manufacture the first tongues 8 and/or the second tongues 9 separately from the inside plate 3 and then attach it/them to the inside plate 3.

According to FIGS. 2 and 3, the inside plate 3 extends essentially in a first plane 10. The arrangement of the first tongues 8 is expediently here such that they also extend in the first plane 10. At the same time, this results in the first tongues 8 also being essentially attached at their free ends 11 to the first inside pipe 4 in the first plane 10. The first tongues 8 are attached at the free end 12 of the first inside pipe 4, i.e., in the sliding seat area 6. The first tongues 8 are thus elastically mobility perpendicular to the first plane 10.

In contrast with that, the second tongues 9 are attached at their free ends 13 to the second inside pipe 5 in a second plane 14 running parallel to and at a distance from the first plane 10. The second tongues 9 are also attached to the second inside pipe 5 in the area of the free end 15 of the second inside pipe 5, i.e., in the sliding seat area 6. In addition, the second tongues 9 each have an essentially linear section 16 which has the particular free end 13 and extends essentially in the second plane 14. Furthermore, the second tongues 9 are each equipped with an angled section 17 which is bent at one end toward the linear section 16 and at the other end away from the inside plate 3. Accordingly, the second tongues 9 are bent away from the inside plates 3 on their fixed ends 18. The second tongues 9 are thus movable with elasticity perpendicular to the second plane 14.

It is essential for the connection of the tongues 8, 9 to the inside pipes 4, 5 that through these connections the axial mobility of the two inside pipes 4, 5 is not hindered in the sliding seat area 6. In particular with respect to FIG. 3 it is important to be sure that a sufficiently great axial distance 19 is provided between the free ends 12 of the first inside pipe 4 and the second tongues 9; this axial distance also helps to prevent an axial collision between the free end 12 in the case of extreme elongation of length of the two inside pipes 4, 5. Accordingly, especially the two planes 10 and 14 which run parallel to one another are spaced a distance apart from one another.

As FIG. 1 shows, when punching out and/or cutting free the tongues 8, 9, it is important to be sure in particular that an elastic yielding of the particular tongues 8, 9 triggers the least possible stresses in the inside plate 3 so that cracking in particular can be avoided.

What is claimed is:

1. A muffler for a line conveying gas and airborne sound, for an exhaust system of an internal combustion engine comprising:

a housing in which there are at least two inside pipes for carrying gas in the interior of the housing and which contains at least one inside plate for reinforcing the housing;

the two inside pipes inserted one inside the other in a sliding seat area and axially movable in relation to one another, the two inside pipes passing through the inside plate in the sliding seat area;

the inside plate having at least one elastic first tongue which is fixedly connected to the one inside pipe;

wherein the inside plate also has at least one elastic second tongue which is fixedly connected to the other inside pipe and has elastic mobility independently of the at least one first tongue.

2. The muffler according to claim 1, wherein the tongues are formed on the inside plate by free cutting or free punching.

3. The muffler according to claim 1, wherein the at least one second tongue is angled away from the inside plate on its fixed end.

4. The muffler according to claim 1, wherein the at least one second tongue is attached at its free end to the other inside pipe in a second plane which is a distance away from the first plane in which the inside plate extends.

5. The muffler according to claim 4, wherein the at least one second tongue has a linear section which includes the free end and extends essentially in the second plane.

6. The muffler according to claim 1, wherein the at least one first tongue is attached at its free end to an inside pipe in a first plane in which the inside plate extends.

7. The muffler according to any one of claim 1, wherein the at least one first tongue extends essentially in a first plane in which the inside plate also extends.

8. The muffler according to claim 1, wherein two diametrically opposed first tongues are provided, or two diametrically opposed second tongues are provided, or two diametrically opposed first tongues and two diametrically opposed second tongues in between are provided.

9. The muffler according to claim 1, wherein the inside pipes are arranged with a radial distance between them in the sliding seat area.

* * * * *